US009999915B2

(12) United States Patent
Clark

(10) Patent No.: US 9,999,915 B2
(45) Date of Patent: Jun. 19, 2018

(54) ENHANCED MULTIPURPOSE TWIST TIE AND METHOD OF FABRICATION AND OPERATION

(71) Applicant: Kevin Clark, Draper, UT (US)

(72) Inventor: Kevin Clark, Draper, UT (US)

( * ) Notice: Subject to any disclaimer, the term of this patent is extended or adjusted under 35 U.S.C. 154(b) by 397 days.

(21) Appl. No.: 14/919,651

(22) Filed: Oct. 21, 2015

(65) Prior Publication Data

US 2016/0355309 A1 Dec. 8, 2016

(51) Int. Cl.
*B21F 45/16* (2006.01)
*B65D 63/12* (2006.01)

(52) U.S. Cl.
CPC ..... *B21F 45/16* (2013.01); *B65D 63/12* (2013.01)

(58) Field of Classification Search
CPC ..... B65D 63/12; B21F 45/16
USPC ..... 24/30.5 T, 16 PB, 16 R, 27
See application file for complete search history.

(56) References Cited

U.S. PATENT DOCUMENTS 3,426,393 A * 2/1969 Mead ..... B65D 63/10 24/30.5 T
4,648,414 A * 3/1987 Fox ..... A45D 8/34 132/246
7,011,879 B1 * 3/2006 Contreras ..... B65D 33/30 24/30.5 T
7,192,069 B1 * 3/2007 Daniel ..... A63C 11/025 24/16 R
D616,292 S 5/2010 Martinson
8,732,914 B2 * 5/2014 Browne ..... B65D 63/1027 24/16 R
8,776,322 B2 7/2014 Martinson
2005/0015937 A1 * 1/2005 Huang ..... B65D 63/10 24/16 PB
2016/0278463 A1 * 9/2016 Stevenson ..... A41F 19/00

* cited by examiner

*Primary Examiner* — Ruth Ilan
(74) *Attorney, Agent, or Firm* — Steven Rinehart

(57) ABSTRACT

An enhanced multipurpose twist tie is formed with two helically disposed wires encased in a sheath having a polygon shaped cross section, a longitudinal ridges, and detachable end caps. The wires are defined by a longitudinal length and a pair of wire termini. The wires intertwine in a helical configuration along the length of the sheath. The helical configuration compresses the wires together and also allows for a greater concentration of wire to be fit into the sheath. The sheath is defined by an outer face having a plurality of longitudinal ridges that extend along the length of the sheath to provide a grip for facilitated twisting and tying of the twist tie. An inner face has a polygon shaped cross section that restricts longitudinal and rotational slippage by the wires. The end caps detachably attach at sheath termini to form a smooth surface over wire termini.

19 Claims, 4 Drawing Sheets

ENHANCED MULTIPURPOSE TWIST TIE AND METHOD OF FABRICATION AND OPERATION

FIELD OF THE INVENTION

This invention relates to an enhanced multipurpose twist tie and method of fabrication and operation, and more particularly relates to an enhanced multipurpose twist tie.

BACKGROUND

Description of the Related Art

Typically, a twist-tie is comprised of a length of wire embedded in a paper or plastic strip. The wire strength is such that the device may be easily looped about the open end of a bag or other object requiring closure or retention and the wire may then be twisted about itself. In many instances, the twist tie can also be used to securely hang objects to a mounting surface. A twist tie is used by wrapping it around the item to be fastened, then twisting the ends together.

Typically, the wires have a limited shape memory. Thus, as soon as the twist tie is released, it returns to another shape. Sometimes more shape memory is beneficial when tying together similar objects repetitively. The wires in the twist tie are often a light metal wire having about 27 gauge thickness. This generally weak fabrication restricts the twist tie from supporting heavier objects to closing around pressurized openings.

In many instances, the wires have a tendency to slide out of the outer covering, or the outer covering separates form the wire. This reduces the service life of the twisty tie. There is no adherence or mechanism to maintain fixed contact between the wire and the outer cover.

In view of the foregoing, it is clear that these traditional twist ties with their fragile fabrications and limited fastening capacity are not perfect and leave room for more optimal approaches for twisting and tying around an open bag or fastening an object to a mounting surface.

SUMMARY

From the foregoing discussion, it should be apparent that a need exists for an enhanced multipurpose twist tie that serves as a closure mechanism operable by twisting and tying with enhanced shape memory and providing a grip for manipulating the twist tie to a desired shape. Beneficially, such a twist tie would create a more secure closure around an open container, or fastening mechanism for an object, and also facilitate the act of twisting and tying the twist tie.

The present invention has been developed in response to the present state of the art, and in particular, in response to the problems and needs in the art that have not yet been fully solved by currently available twist ties. Accordingly, the present invention has been developed to provide a twist tie for containers and objects that overcomes many or all of the above-discussed shortcomings in the art.

The enhanced multipurpose twist tie is provided with a plurality of modules configured to functionally execute the necessary steps of twisting and tying the twist tie around an opening of a container or an object. These modules in the described embodiments include an enhanced multipurpose twist tie that is formed with two helically disposed wires encased in a sheath having a polygon shaped cross section, a plurality of longitudinal ridges, and a pair of detachable end caps.

The wires are defined by a longitudinal length and a pair of wire termini. The wires intertwine in a helical configuration along the length of the sheath. The generally helical configuration serves to compress the wires together and also allows for a greater concentration of wire to be fit into the sheath. This helps create more rigid, memory retaining malleability characteristics for the wires. In one embodiment, the helical configuration of the wires enable enhanced retention of memory of prior shapes. The helically configured wires also create a more rigid configuration in the shape at which the wires are deformed.

The sheath is defined by an outer face having a plurality of longitudinal ridges that extend along the length of the sheath to provide a grip for facilitated twisting and tying of the twist tie. The sheath is further defined by an inner face that engages the wires. The inner face has a polygon shaped cross section that restricts longitudinal and rotational slippage by the wires. The end caps detachably attach at the termini of the sheath, covering the wires to form a smooth surface at the termini.

The twist tie, in one embodiment, is configured to twist and tie the twist tie around an opening of a container or an object.

The twist tie is further configured, in one embodiment, to more effectively retain memory of prior shapes due to the helical configuration of the wires.

In a further embodiment, the twist tie forms a more rigid configuration due to the helical configuration of the wires.

In a further embodiment, a polygon shaped inner face of the sheath may be configured to restrict slippage of the wires.

In a further embodiment, the longitudinal ridges that extend along the length of the sheath provide an enhanced grip for twisting, tying, and general manipulation of the twist tie.

In a further embodiment, the sheath forms generally smooth sheath termini through detachable attachment of a pair of rounded end caps.

A method of the present invention is also presented for fabricating and manipulating the enhanced multipurpose twist tie. The method in the disclosed embodiments substantially includes the steps necessary to carry out the functions presented above with respect to the operation of the described twist tie. In one embodiment, the method includes intertwining a pair of wires in a generally helical configuration. The method also may include encasing the helically configured wires within an inner face of the sheath.

In a further embodiment, the method includes restricting longitudinal and rotational slippage of the wires through a polygon shaped cross section.

The method further includes a step of gripping a plurality of longitudinal ridges on an outer face of the sheath for manipulating the twist tie.

In a further embodiment, the method comprises attaching a pair of end caps to a pair of sheath termini to at least partially cover a pair of protruding wire termini.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
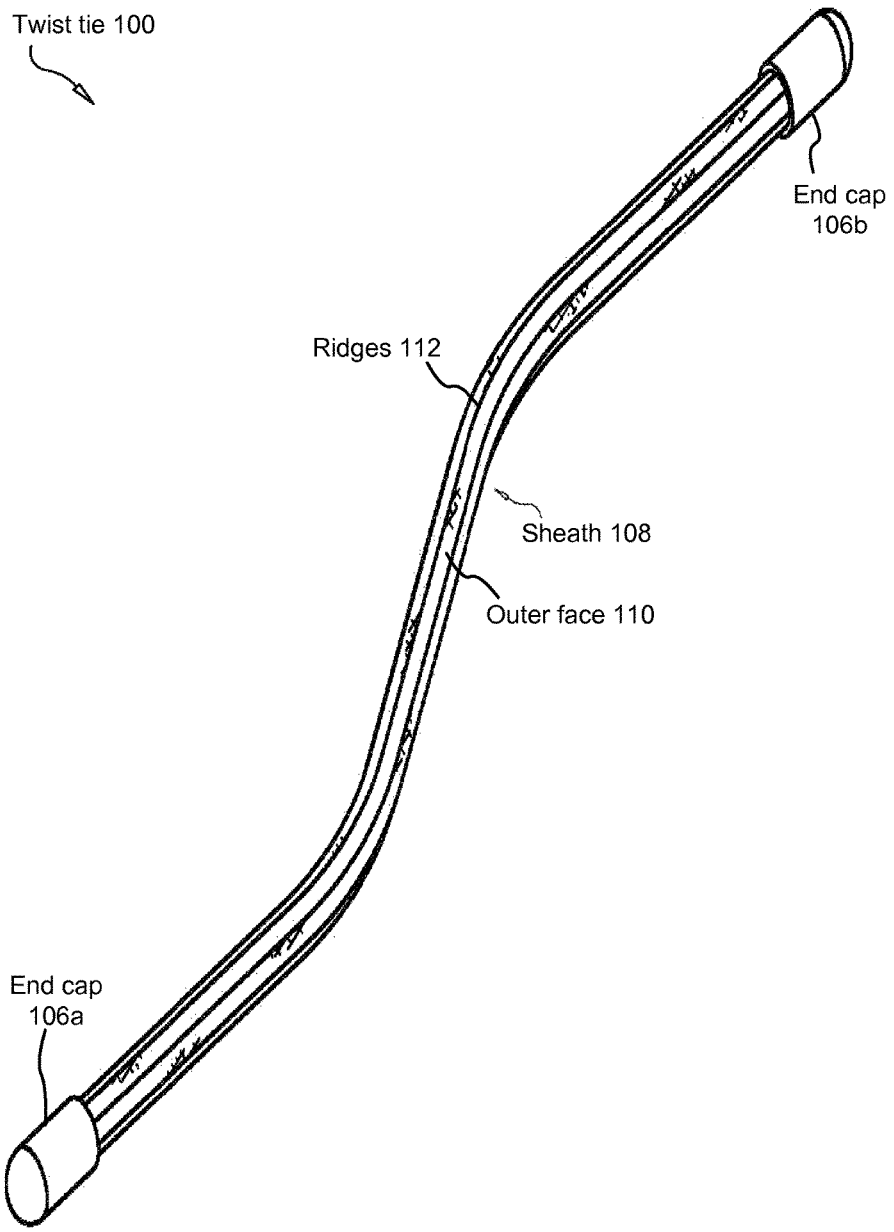
FIG. 1 is a perspective view illustrating one embodiment of an enhanced multipurpose twist tie with a pair of end caps attached to a pair of sheath termini in accordance with the present invention.

FIG. 1 depicts an enhanced multipurpose twist tie 100 that is formed from two helically disposed wires 102*a-b* encased in a sheath 108 having a polygon shaped cross section 116, a plurality of longitudinal ridges 112, and a pair of detachable end caps 106*a-b*.

The twist tie is formed, in some embodiments, with two helically disposed wires encased in a sheath having a polygon shaped cross section, a plurality of longitudinal ridges, and a pair of end caps; whereby the helical configuration of the wires enable enhanced retention of memory of prior shapes and a more rigid configuration in the shape at which the wires are deformed, the polygon shaped cross section of the sheath restricts longitudinal and rotational slippage by the wires, the longitudinal ridges of the sheath provide a grip for twisting and tying the twist tie, and the end caps cover the wire termini to form a smooth surface at the sheath termini.

The enhanced multipurpose twist tie 100, hereafter, "twist tie 100", is configured to form a closure around an opening of a container, or for fastening an object to a mounting surface. The twist tie 100 is sufficiently malleable so as to twist, tie, bend, and generally contort to a desired shape while also providing enhanced shape memory. The twist tie 100 further provides an enhanced grip in the form of longitudinal ridges 112 or depressions that enable a user to have a secure grip while manipulating the twist tie 100 to the desired shape.

Figure 2:
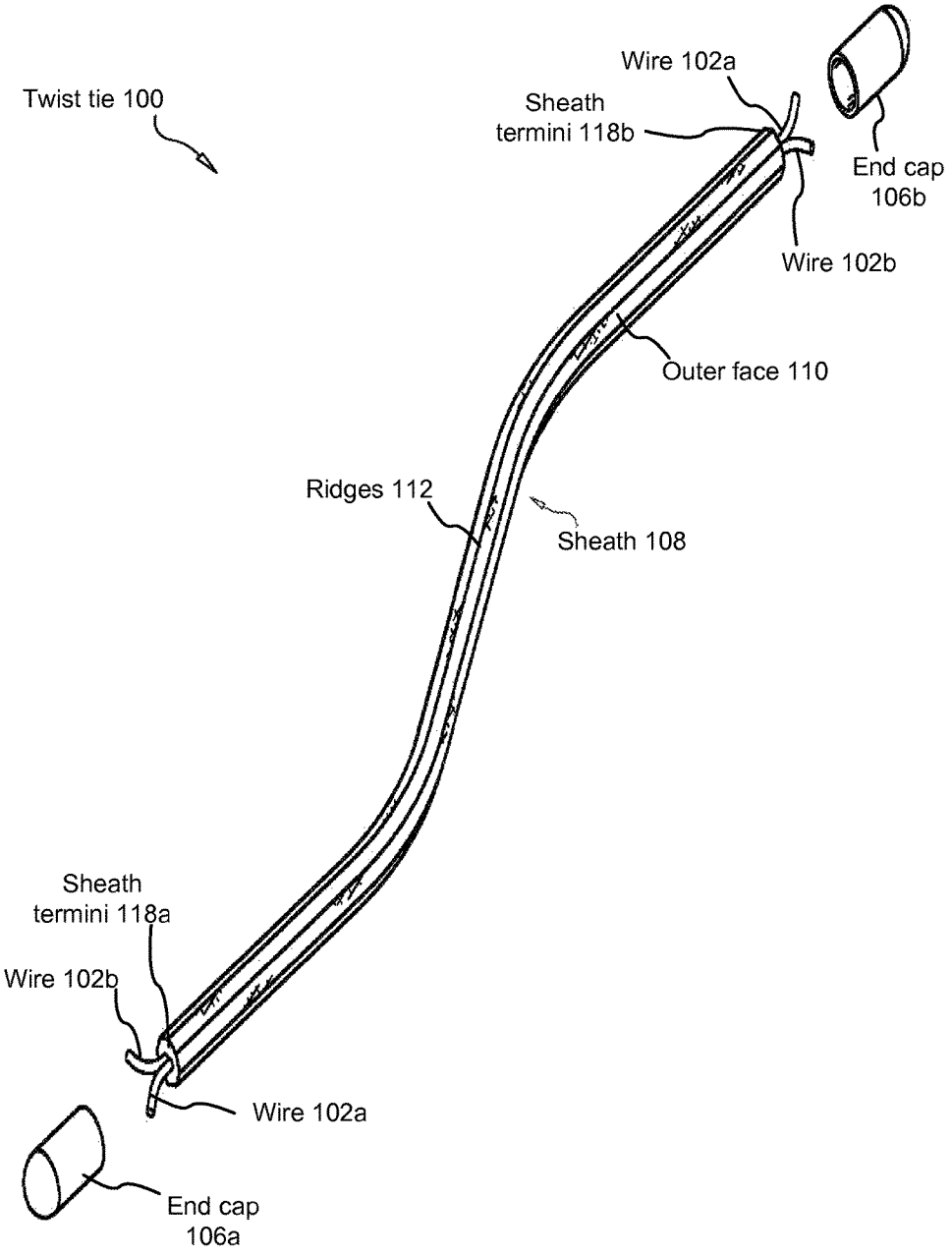
FIG. 2 is a perspective view illustrating one embodiment of an enhanced multipurpose twist tie with a pair of end caps detached to a pair of sheath termini in accordance with the present invention.

Turning now to FIG. 2, the twist tie 100 includes a pair of wires 102*a-b* that form the structural backbone and shape memory means for the twist tie 100. The pair of wires 102*a-b* are configured helically relative to each other. The helical configuration of the wires 102*a-b* enhances their rigidity and shape memory in any number of shapes. In some embodiments, the wires 102*a-b* may be defined by a longitudinal length and a pair of wire termini 104*a-b*. The longitudinal length extends substantially across the length of the sheath 108. In one embodiment, the wires 102*a-b* have a 27 gauge thickness. In other embodiments, the wires 102*a-b* are fabricated from a metal, including, without limitation, tin, aluminum, copper, nickel, and metal alloys. Though in other embodiments, the wires 102*a-b* may be fabricated from a resilient polymer or paper material.

The wires 102*a-b* intertwine in a helical configuration along the length of the sheath 108. The wires 102*a-b* are in contact with each other during the length of their helical disposition. The generally helical configuration of the wires 102*a-b* serves to compress the wires 102*a-b* together. The helical configuration also allows for a greater concentration of wire to be fit within the length of the sheath 108. This compressed configuration helps create more rigid, memory retaining malleability characteristics for the wires 102*a-b*.

In one embodiment, the helical configuration of the wires 102*a-b* enables enhanced retention of memory of prior shapes. The wires 102*a-b*, in essence, hold the twist tie 100 in the desired shape more securely because of the compressed disposition of the helical configuration. The helically configured wires 102*a-b* also create a more rigid configuration in the shape at which the wires 102*a-b* are deformed. Because the wires 102*a-b* are in contact with each other, their tensile strength and rigidity is increased over the prior art that uses separated parallel wires or a single wire.

Figure 3:
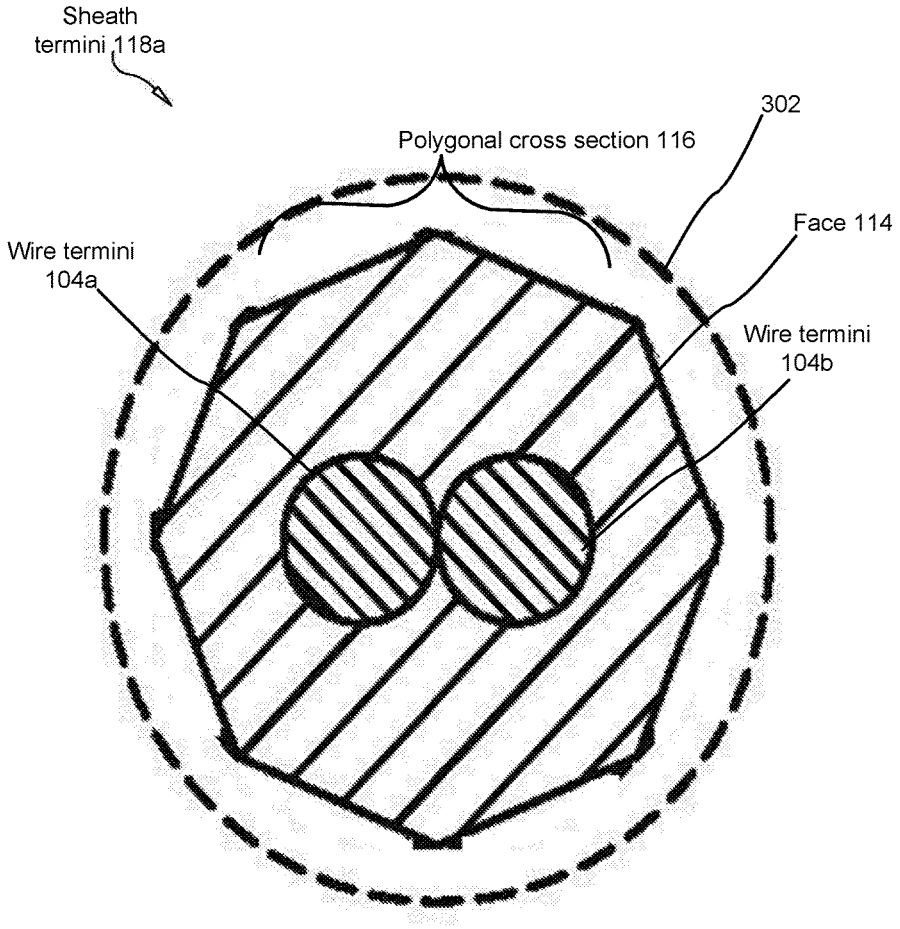
FIG. 3 is an end sectioned view of a sheath termini illustrating a pair of wire termini in accordance with the present invention.

Looking now at FIG. 3, the sheath 108 encases the wires 102*a-b* in a generally concentric disposition. The sheath 108 may be fabricated with a mold, whereby the wires 102*a-b* are integrated therein. Though the wires 102*a-b* may also be pulled through the length of the sheath 108. The sheath 108 is defined by an outer face 110 having a plurality of longitudinal ridges 112 or longitudinal depressions that extend along the length of the outer face 110 of the sheath 108. The longitudinal ridges 112 provide a grip for facilitated twisting and tying of the twist tie 100. In some embodiments, the outer face 110 may be defined by a plurality of depressions. In any case, the ridges 112 and depressions serve in substantially the same function of providing grip and restricting rotation of the sheath 108 on an inclined surface.

As FIG. 3 illustrates, the sheath 108 is further defined by an inner face 114 that engages the wires 102*a-b*. The inner face 114 has a polygon shaped cross section 116 that restricts longitudinal and rotational slippage by the wires 102*a-b*. The flat sides of the polygonal shape form corners at their junctions. The formed corners are configured to restrict movement by the helically disposed wires 102*a-b*. In one embodiment, the polygonal shaped cross section 116 is an octagonal shape. Though in other embodiments, any number of shapes may be used, including a pentagon, a hexagon, and a decagon. In any case, a corner forms at the junction of the sides of the inner face 114 to restrict longitudinal and rotational movement by the wires 102*a-b*.

The face 114 may be the outer face of the twist tie, or may be circumscribed/enveloped by another outer sheath 302. The shown face 114 is octagonal, but may be polygonal, having five, six, seven, eight, nine or more facets or sides.

Looking back at FIG. 2, the sheath 108 is further defined by a pair of sheath termini 118*a-b*. The wire termini 104*a-b* may extend slightly form the sheath termini 118*a-b*. The twist tie 100 further comprises a pair of end caps 106*a-b* that detachably attach at the sheath termini 118*a-b*; thereby at least partially covering the wire termini 104*a-b* to form a smooth surface. The end caps 106*a-b* prevent the generally sharp wire termini 104*a-b* from snagging onto an object or cutting a user while manipulating the twist tie 100. The end caps 106*a-b* may include plastic rounded ends that form a friction fit over the sheath termini 118*a-b*. Though in other embodiments, the end caps 106*a-b* may be threaded and rotatably engage the sheath termini 118*a-b*.

The end caps 106 may be detachable using means known to those of skill in the art, or may be formed as one integrated piece with the sheath or sleeve enveloping the helical wires or twist tie.

In various embodiments, the wires may be wound in helical fashion around one another, or may be disposed (or oriented) in parallel to one another.

Figure 4:
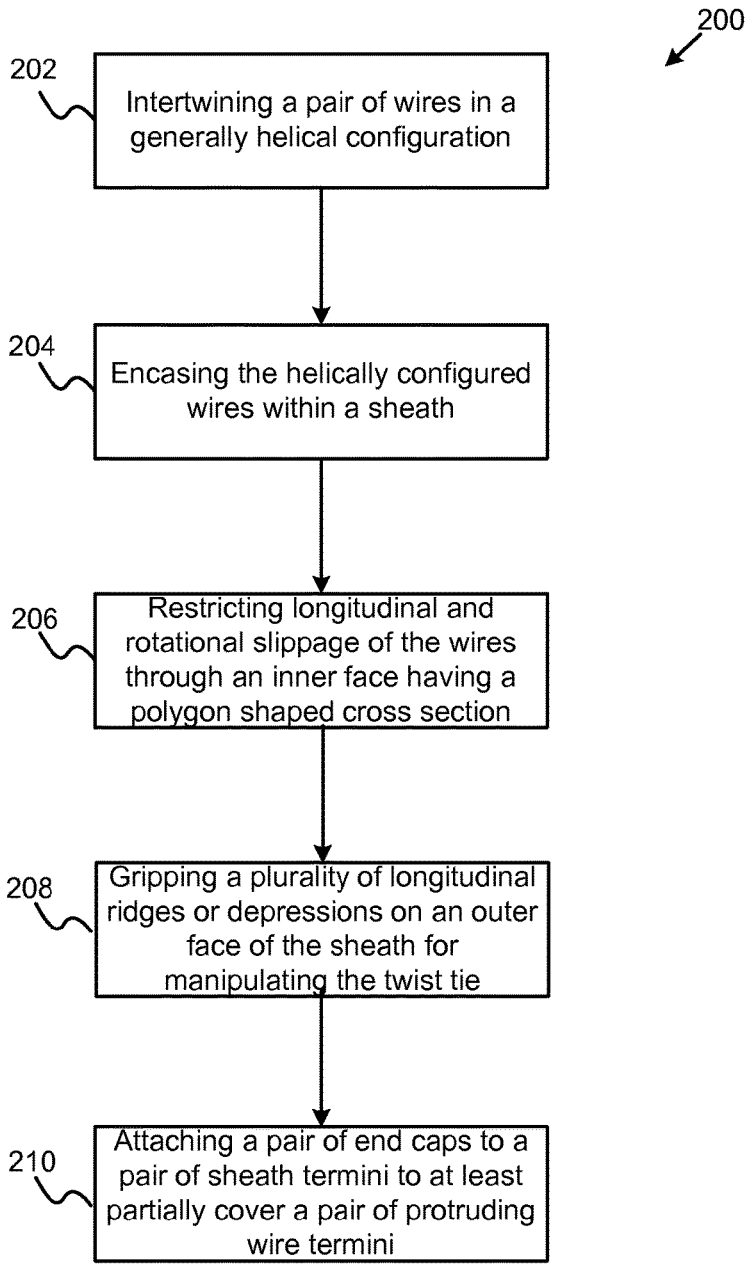
FIG. 4 is a flowchart diagram of a method for fabricating and operating an enhanced multipurpose twist tie.

FIG. 4 references a flowchart diagram of an exemplary method 200 for fabrication and use of an enhanced multipurpose twist tie. The method 200 in the disclosed embodiments substantially includes the steps necessary to carry out the functions presented above with respect to the operation of the described twist tie 100. In one embodiment, the method 200 includes an initial Step 202 of intertwining a pair of wires 102*a-b* in a generally helical configuration. The wires 102*a-b* intertwine in a helical configuration along the length of the sheath 108. The wires 102*a-b* are in contact with each other during the length of their helical disposition.

The method also may include a Step 204 of encasing the helically configured wires 102*a-b* within a sheath 108. The sheath 108 may be fabricated with a mold, whereby the wires 102*a-b* are integrated therein. Though the wires 102*a-b* may also be pulled through the sheath 108.

In a further embodiment, the method includes a Step 206 of restricting longitudinal and rotational slippage of the wires 102*a-b* through an inner face 114 having a polygon shaped cross section 116. The polygon shaped cross section 116 is configured to help restrict both longitudinal and rotational slippage by the wires 102*a-b*. The flat sides of the polygonal shaped cross section 116 form corners at their junctions. The corners are configured to restrict movement by the helically disposed wires 102*a-b*.

The method further includes a Step 208 of gripping a plurality of longitudinal ridges 112 or depressions on an outer face 302 of the sheath 108 for manipulating the twist tie 100. The plurality of longitudinal ridges 112 or depressions extend along the length of the sheath 108 to provide a grip for facilitated twisting and tying of the twist tie 100, and for preventing rotational movement by the sheath 108 on an inclined surface.

In a further embodiment, the method comprises a Step 210 of attaching a pair of end caps 106*a-b* to a pair of sheath termini 118*a-b* to at least partially cover a pair of protruding wire termini 104*a-b*. The pair of end caps 106*a-b* detachably attach at the sheath termini 118*a-b*, thereby covering the wires 102*a-b* to form a smooth surface.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A twist tie for enabling twisting and tying, the twist tie comprising:

a pair of deformable wires, the pair of wires defined by a longitudinal axis and a pair of wire termini, the pair of wires disposed in a generally helical configuration;

a sheath, the sheath configured to at least partially encase the pair of wires, the sheath defined by an outer face having a generally polygon shaped cross section, the polygon shaped cross section of the outer face of the sheath configured to help restrict longitudinal and rotational movement of items wrapped with the twist tie, the outer face having a plurality of longitudinal ridges, the plurality of longitudinal ridges configured to enable formation of a grip for enhanced manipulation of the twist tie, the sheath further defined by a pair of sheath termini, whereby the pair of wire termini at least partially protrude from the sheath termini; and a pair of cap ends, the pair of cap ends configured to attach to the pair of sheath termini, whereby the pair of wire termini are detachably covered.

2. The twist tie of claim 1, wherein the pair of wires are metal.

3. The twist tie of claim 1, wherein the pair of wires contact each other in the helical configuration.

4. The twist tie of claim 1, wherein the helical configuration of the pair of wires compresses the wires in the sheath.

5. The twist tie of claim 1, wherein the pair of wires are concentrically disposed in the sheath.

6. The twist tie of claim 1, wherein the sheath is a plastic, poly, paper, or metallic material.

7. The twist tie of claim 1, wherein the polygon shaped cross section of the outer face of the sheath is an octagonal shape.

8. The twist tie of claim 1, wherein the pair of end caps are plastic and generally rounded.

9. A twist tie for enabling twisting and tying, the twist tie comprising:

a pair of wires, the pair of wires defined by a longitudinal axis and a pair of wire termini, the pair of wires disposed in a generally helical configuration;

a sheath, the sheath configured to at least partially encase the pair of wires, the sheath defined by an inner face having a generally octagonal shaped cross section, the octagonal shaped cross section of the inner face of the sheath configured to help restrict longitudinal and rotational movement by the pair of wires, the sheath further defined by an outer face having a plurality of longitudinal depressions, the plurality of longitudinal depressions configured to enable formation of a grip for enhanced manipulation of the twist tie, the sheath further defined by a pair of sheath termini, whereby the pair of wire termini at least partially protrude from the sheath termini; and a pair of cap ends, the pair of cap ends configured to detachably attach to the pair of sheath termini, whereby the pair of wire termini are detachably covered.

10. The twist tie of claim 9, wherein the pair of wires are metal.

11. The twist tie of claim 9, wherein the pair of wires contact each other in the helical configuration.

12. The twist tie of claim 9, wherein the helical configuration of the pair of wires compresses the wires in the sheath.

13. The twist tie of claim 9, wherein the pair of wires are concentrically disposed in the sheath.

14. The twist tie of claim 9, wherein the sheath is a plastic, poly, paper, or metallic material.

15. The twist tie of claim 9, wherein the outer face of the sheath has a generally cylindrical shape.

16. The twist tie of claim 9, wherein the pair of end caps are plastic and generally rounded.

17. A method for fabricating and operating a multipurpose twist tie, the method comprising:

intertwining a pair of wires in a generally helical configuration;

encasing the helically configured wires within a sheath;

restricting longitudinal and rotational slippage of the wires through an inner face having a polygon shaped cross section;

gripping a plurality of longitudinal ridges or depressions on an outer face of the sheath for manipulating the twist tie; and attaching a pair of end caps to a pair of sheath termini to at least partially cover a pair of protruding wire termini.

18. The method of claim 17, wherein the pair of wires contact each other in the helical configuration.

19. The method of claim 17, wherein the helical configuration of the pair of wires compresses the wires in the sheath.

* * * * *